United States Patent [19]

Schoepe

[11] 4,327,941

[45] May 4, 1982

[54] REFILL HOSE MOUNTING MEMBER AND RETAINER FOR BALL COCKS

[76] Inventor: Adolf Schoepe, 1620 N. Raymond Ave., Fullerton, Calif. 92631

[21] Appl. No.: 157,499

[22] Filed: Jun. 9, 1980

[51] Int. Cl.[3] ..... F16L 43/00

[52] U.S. Cl. ..... 285/23; 137/441; 285/179

[58] Field of Search ..... 285/179, 23, 12; 248/75, 79; 137/441; 4/395, 366

[56] References Cited

U.S. PATENT DOCUMENTS

| | | | |
|---|---|---|---|
| 2,787,005 | 4/1957 | Zinkil . | |
| 2,937,661 | 5/1960 | Whitmore | 285/179 X |
| 2,966,320 | 12/1960 | Schoepe et al. . | |
| 3,319,913 | 5/1967 | Schoepe et al. . | |
| 3,863,958 | 2/1975 | Todd | 285/12 |

FOREIGN PATENT DOCUMENTS

| | | | |
|---|---|---|---|
| 2288930 | 5/1976 | France | 285/179 |
| 7802712 | 9/1979 | Netherlands | 285/23 |
| 1094477 | 12/1967 | United Kingdom | 285/179 |

*Primary Examiner*—Thomas F. Callaghan
*Attorney, Agent, or Firm*—Mahoney & Schick

[57] ABSTRACT

A rigid plastic elbow has a fluid passage formed therethrough from a relatively straight refill hose connecting portion and through a reduced length relatively straight overflow tube discharge portion. The refill hose connecting portion is connectable to an end of a flexible refill hose directing water from a water level control valve in a toilet flush tank. A flexible metal clip secured to the overflow tube discharge portion mounts the mounting member on the upper end of a vertical overflow tube of the toilet flush tank with the overflow tube discharge portion directing water from the refill hose downwardly into the overflow tube upper end. Prior to the assembly of the water level control valve in a toilet flush tank and during shipment of the overall assembly, certain valve mounting parts may be temporarily removably telescoped over the elbow refill hose connecting portion retained thereon by certain of the overflow tube discharge portion and metal clip at the one side and particularly formed projecting tabs at the other side.

4 Claims, 5 Drawing Figures

REFILL HOSE MOUNTING MEMBER AND RETAINER FOR BALL COCKS

BACKGROUND OF THE INVENTION

This invention relates to a refill hose mounting member and retainer for water level control valves or ball cocks in toilet flush tanks. More particularly, this invention relates to a unique, rigid mounting member and retainer which is connectable to the refill hose of a water level control valve in a toilet flush tank and has retainer or positioning means integrated therewith for positioning the mounting member directing water therefrom downwardly into the upper end of a generally vertical overflow tube in a precise and predictable manner not heretofore possible in prior water level control valve assemblies. Furthermore, prior to the overall assembly of the water level control valve including the refill hose mounting member and retainer of the present invention in a toilet flush tank, and during storage and shipment thereof, the mounting member and retainer may be advantageously used for temporarily storing certain mounting parts for the overall control valve assembly thereon, thereby greatly simplifying the packing materials and procedure normally used for such purposes.

Various forms of ball cocks or water level control valves have long since been used in toilet flush tanks for controlling the water supply necessarily retained therein. In a usual installation, with a flush or discharge valve of the toilet flush tank closed, a supply of water is directed into the flush tank through the water level control valve and when the water level in the flush tank reaches a predetermined level, the water level control valve automatically closes and remains so positioned awaiting a toilet flushing operation. In carrying out the toilet flushing operation, the separate discharge valve is opened permitting the predetermined water supply in the flush tank to flow downwardly through the toilet, the discharge valve ultimately automatically reclosing when the water level in the flush tank has reached a predetermined lower level. At the same time, during this water exiting flow procedure through the discharge valve, the water level control valve automatically opens so that when the discharge valve ultimately closes, the flush tank is once again refilled to its predetermined water level awaiting the beginning of the next flushing operation.

The foregoing is typical of the basic toilet flushing operation, but in addition thereto, it is necessary between flushing operations to maintain a predetermined water level at all times in the toilet and this refill water is supplied to the toilet in the latter stages of the flushing operation by a subsidiary refill hose connected to the water level control valve and directing a relatively small amount of the flush tank water supply to the toilet separate from that passing through the flush tank discharge valve. During a flushing operation, when the water level control valve is opened, a portion of the water being released thereby passes through the refill hose and is directed from the end of the refill hose usually into an upper open end of a vertical overflow tube mounted in the flush tank. The overflow tube is permanently upwardly open and permanently downwardly communicates with the toilet, thereby serving two purposes, one to receive flush tank water directly downwardly therethrough and through the toilet in the event the water level control valve malfunctions and the water level in the flush tank rises beyond its predetermined level so as to prevent an overflow of the flush tank itself and the other for directing the supply of refill water into the toilet during each flushing operation.

One of the basic problems encountered with water level control valve assemblies has involved the positioning and maintaining of a flexible refill hose from the water level control valve properly directing the refill water supply into the open upper end of the overflow tube. Flexible refill hoses are used for various reasons including varying required distances between water level control valves and overflow tubes in the flush tanks of different toilet models, as well as for efficiency and economy. The ends of the flexible refill hoses have normally been positioned and retained at the open upper ends of the overflow tubes by means of metal clips having an upper portion engaging and retaining the end of the refill hose and a lower portion engaging the upper end of the overflow tube. In this manner, it is attempted to relatively precisely position the end of the refill hose for properly directing the refill water supply downwardly into the overflow tube.

This means of retaining the end of the flexible refill hose positioned relative to the open upper end of the overflow tube has not always been totally satisfactory. Obviously, if all of the refill water supply is not properly directed into the overflow tube for reception by the toilet during each flushing operation, a proper water level will not be maintained in the toilet between the flushing operations. Thus, it is clear that the maintaining of the proper positioning of the flexible refill hose is an important adjunct to the satisfactory operation of the overall water level control valve assembly and failure or partial failure thereof will destroy the overall efficiency, if not make the overall operation completely prohibitive.

OBJECTS AND SUMMARY OF THE INVENTION

It is, therefore, an object of this invention to provide a refill hose mounting member and retainer or positioner which is of a unique and more positively operable nature, and will more efficiently insure that the refill hose will always be maintained properly positioned in the performance of its intended function. According to a preferred embodiment thereof, the refill hose mounting member is of a rigid and substantial nature so as to provide an intervening member between the end of the flexible hose from the water level control valve and the flush tank overflow tube. It eliminates any attempt to connect the end of the refill hose with the overflow tube in proper positioning thereon by a relatively slight metal clip. The rigid mounting member fluid communicates with the refill hose receiving the refill water supply therefrom and positively directs the same into the overflow tube with the positioning of the mounting member on the overflow tube being by the retainer or positioner integrated therewith and which is of a more positive nature due to the substance of the mounting member.

It is a further object of this invention to provide a refill hose mounting member and retainer of the general type hereinbefore described which provides the best attributes of each of flexible refill hoses and metal refill tubes, while effectively eliminating the disadvantages of each. In the preferred embodiment of the present invention, by integrating the refill hose mounting member with a flexible refill hose, all of the advantages of the flexible refill hose are retained permitting the adaption of the combination to varying distances between the water level control valve and the overflow tube as is encountered in different toilet flush tank installations, thereby retaining the maximum versatility. At the same time, due to the substantial rigid construction of the refill hose mounting member and the absolute direction of refill water therethrough, the retainer incorporated therewith for mounting the refill hose mounting member on the upper end of the overflow tube in a secure and positive position is accomplished in an efficient manner. There is no necessity of attempting to mount and position the end of a flexible refill hose on the overflow tube solely by the prior, relatively slight, metal clips with which difficulty is encountered in attempting to engage and retain the flexible refill hose.

It is still a further object of this invention to provide a refill hose mounting member and retainer satisfying the foregoing objects and offering all of the above advantages which additionally has an auxiliary use prior to the assembly and mounting of a particular ball cock in a flush tank, the ball cock being the assembly with which the refill hose mounting member of the present invention has been incorporated. Once a ball cock has been manufactured and is in final form ready for mounting within a toilet flush tank, the ball cock is packed for shipment and retained in storage until such shipment takes place, this packing of the ball cock including various ball cock mounting parts which must be retained separately ready for final use and also including the refill hose mounting member of the present invention likewise ready for final mounting and use. By forming the refill hose mounting member of the present invention in a particular unique manner, it is possible to temporarily telescope over a portion thereof for temporary retainment all of the ball cock mounting parts ultimately used in the ball cock mounting operation. Thus, these ball cock mounting parts are securely retained during storage and shipment of the overall ball cock assembly and in the final ultimate mounting of the ball cock in a flush tank, the mounting parts may be selectively removed for their intended use. This, thereby, eliminates the necessity of additional packing materials, as well as insuring that all mounting parts will be available as is necessary at final ball cock installation time.

Other objects and advantages of the invention will be apparent from the following specifications and the accompanying drawings which are for the purpose of illustration only.

DESCRIPTION OF THE BEST EMBODIMENT CONTEMPLATED

Figure 1:
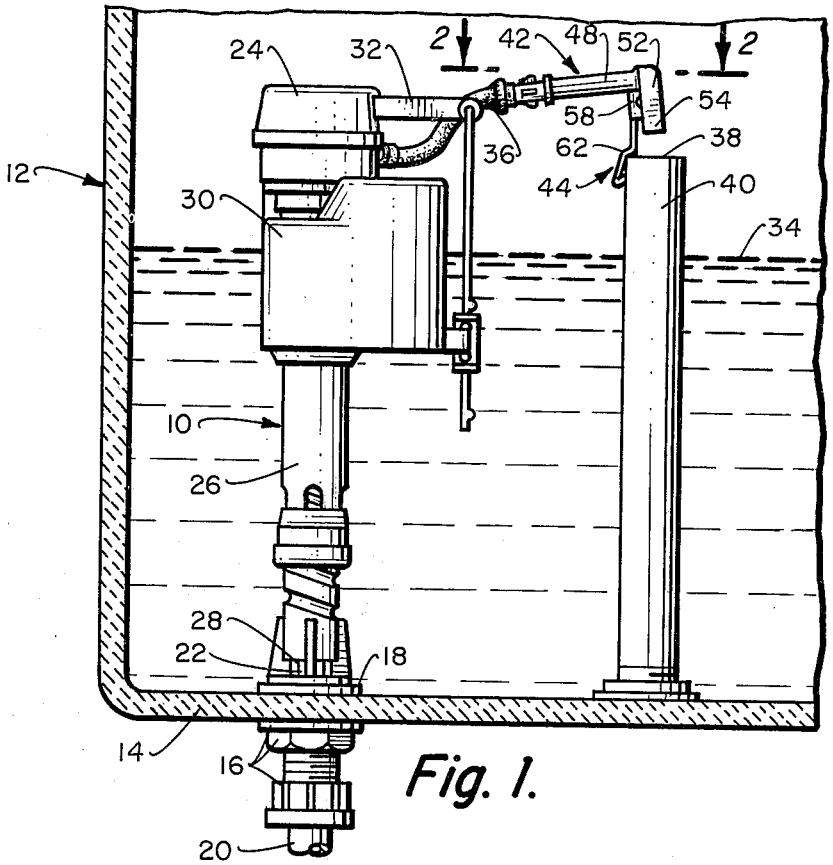
FIG. 1 is a front elevational view of a typical water level control valve having a preferred embodiment of the refill hose mounting member and retainer of the present invention assembled therewith and directing refill water into the overflow tube of a typical toilet flush tank, the toilet flush tank being shown in fragmentary vertical sections.

Referring to FIG. 1 of the drawings, a preferred embodiment of the refill hose mounting member and retainer or positioner of the present invention is shown in a typical environmental assembly including a water level control valve or ball cock generally indicated at 10 mounted in a toilet flush tank generally indicated at 12. The water level control valve 10 is secured to a bottom wall 14 of the flush tank 12 receiving inlet water therethrough by a multiplicity of usual mounting parts 16 preferably specifically including a resilient washer 18. The water level control valve 10 receives its inlet water supply from a water supply pipe 20 secured in fluid communication therewith downwardly of the flush tank bottom wall 14 as shown.

In typical manner, the inlet water received from the water supply pipe 20 passes upwardly through the bottom wall 14 of the flush tank 12 and internally of the water level control valve 10 through a water inlet tube 22 to an upper valve assembly 24 and when the valve assembly is in a valve open position, the inlet water passes therethrough and reverses downwardly through a water outlet tube 26 telescoping the inlet tube. Ultimately, the water exits the water level control valve 10 through an outlet opening 28 at the lower end of the water outlet tube 26 and adjacent the flush tank bottom wall 14. The opening and closing of the valve assembly 24 is controlled by a vertically movable float 30 movably telescoping the water outlet tube 26 and pivotally secured to a valve control lever 32 of the valve assembly 24.

In typical fashion, therefore, the water level control valve 10 controls the level of the water within the flush tank 12. Assuming the maximum water level 34 as shown in FIG. 1, when a selectively operable outlet valve (not shown) in the bottom wall 14 of the flush tank 12 is opened, the water in the flush tank flows downwardly through the bottom wall and through a toilet (not shown) for flushing the same and as the water level decreases, the float 30 moves downwardly therewith. Ultimately, the float 30 moves the valve assembly 24 from closed to open position and also ultimately the flush tank outlet valve automatically closes terminating the toilet flushing operation.

With the outlet valve reclosed, inlet water flowing through the water level control valve 10 and from the outlet opening 28 thereof ultimately refills the toilet flush tank 12 to the maximum water level 34. As the level of inlet water approaches the maximum water level 34, it is carrying the float 30 therewith so that upon the maximum water level being reached, the float once again closes the valve assembly 24 and the water level control valve 10 with its valve assembly closed, maintains the maximum water level 34 within the flush tank 12 awaiting the next selected toilet flushing operation. Therefore, the foregoing operation as described constitutes the main toilet flushing operation of the flush tank 12 and the maintenance of a level of water therein for such flushing action as controlled by the water level control valve 10.

In addition, however, it is necessary at the termination of each toilet flushing operation to have remaining in the bowl of the toilet a certain level of water and this is the toilet refill water supplied by, in this instance, a flexible refill hose 36 forming a part of the assembly of the water level control valve 10. With the usual water level control valve and as is true with the control valve 10 herein, the refill water is merely a portion of the water from the flush tank 12 flowing through the control valve and taken at the downstream side of the valve assembly 24 just before the main water stream enters the upper end of the water outlet tube 26. This refill water is directed off into the refill hose 36 and from the refill hose must be precisely directed into an open upper end 38 of a vertically extending overflow tube 40 mounted within the flush tank 12 spaced from the water level control valve 10 as generally shown in FIG. 1.

The overflow tube 40 opens fully downwardly through the bottom wall 14 of the flush tank 12 also into the bowl of the toilet (not shown) and serves two important functions. One function is to protect the flush tank 12 against water overflow, that is, if the valve assembly 24 of the water level control valve 10 fails in open position admitting a continuous water flow into the flush tank 12 so that the water level within the flush tank continues to rise exceeding the maximum water level 34, such water level will ultimately rise to the open upper end 38 of the overflow tube 40 and the water will begin to flow freely downwardly through the overflow tube and through the toilet so that such water flow can never exceed the capacity of the flush tank 12 which could cause direct overflowing therefrom. The other important function of the overflow tube 40 is on a constant functioning basis of receiving the previously discussed refill water from the refill hose 36 and directing the same down into the bowl of the toilet for refilling the same with its constant quantity at termination of each main flushing action of the water level control valve 10 and it is with this latter functioning that the refill hose mounting member and retainer of the present invention is involved.

Figure 3:
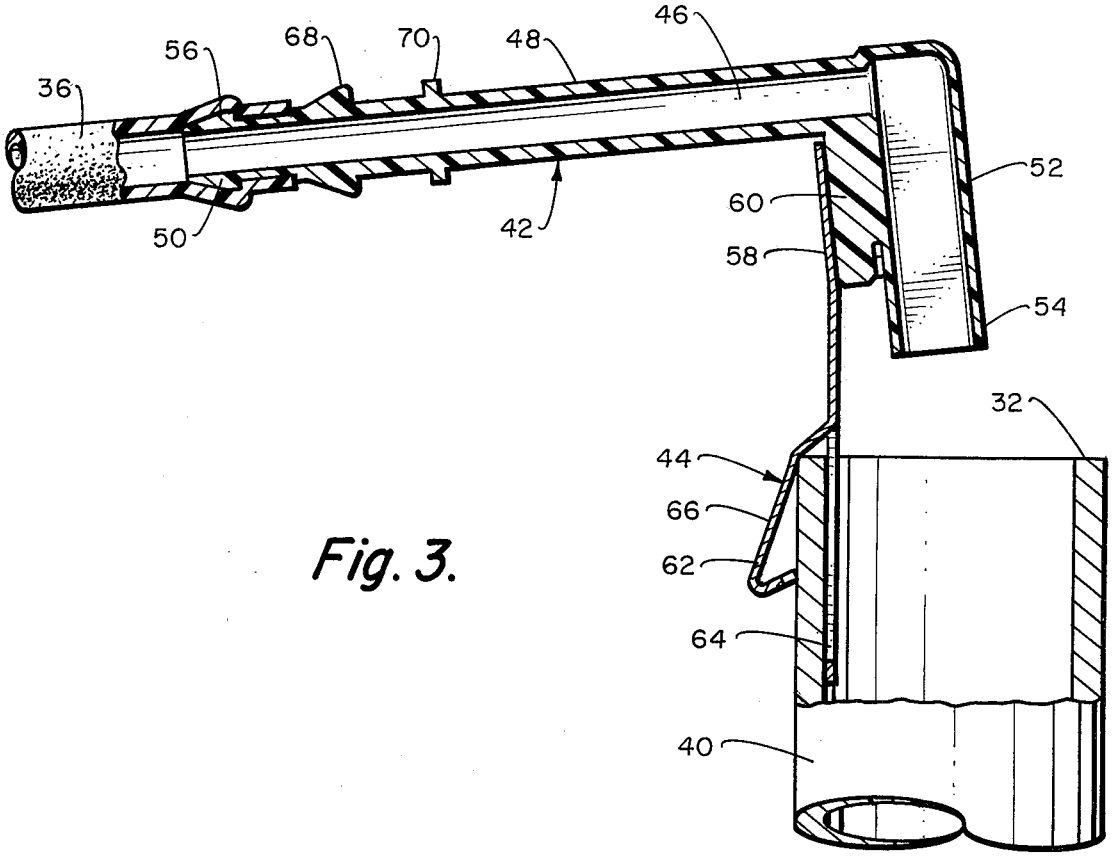
FIG. 3 is a fragmentary, primarily vertical sectional view looking in the direction of the arrows 3—3 in FIG. 2.
Figure 2:
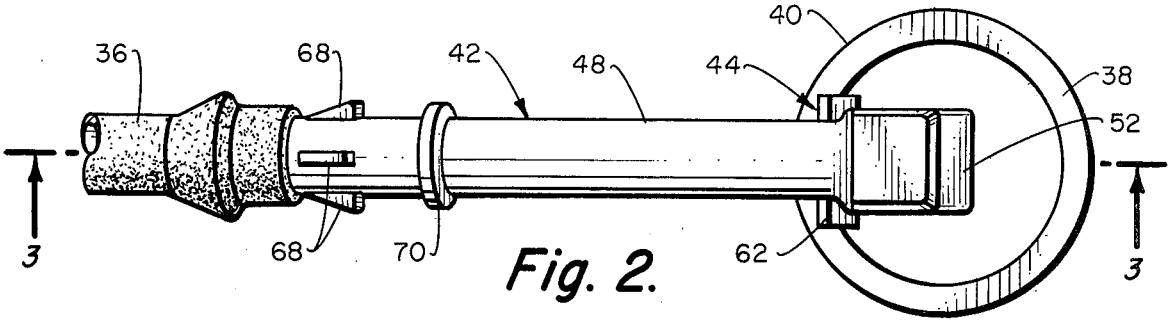
FIG. 2 is an enlarged, fragmentary, top plan view looking in the direction of the arrows 2—2 in FIG. 1.

As shown in the overall assembly in FIGS. 1, 2 and 3, a preferred embodiment of the refill hose mounting member and retainer of the present invention includes a rigid, preferably plastic refill hose mounting member generally indicated at 42 and a preferably spring metal retainer or positioner generally indicated at 44. The mounting member 42 is formed as a rigid elbow comprised of a relatively long and straight refill hose connecting portion 48 commencing at a refill hose connecting end 50 and integrally attached at substantially a right angle to a relatively short or reduced length, relatively straight overflow tube discharge portion 52 terminating in an overflow tube discharge end 54. The connecting end 50 of the refill hose connecting portion 48 is formed with a somewhat conventional outward circumferential flange 56 for securement and gripping of the end of the resilient or flexible refill hose 36 and the fluid passage of the overflow tube discharge portion 52 is slightly enlarged for a smooth flow of refill water from the connecting portion 48 into this discharge portion 52 and from the discharge end 54 thereof.

The retainer or positioner 44 is formed as a spring metal clip and includes an upper, semicircular securement portion 58 which peripherally circumferentially grips a cylindrical attachment portion 60 formed integral with and radially adjacent the refill hose connecting portion 48 of the refill mounting member 42. The retainer 44 also includes an overflow tube gripping portion 62 formed integral with the securement portion 58 and projecting somewhat angularly downwardly with the major portion thereof extending below the overflow tube discharge end 54 of the refill hose mounting member 42 as clearly seen in FIGS. 1, 3 and 4. As probably best seen in FIG. 4, this gripping portion 62 of the retainer 44 is somewhat similar to the prior refill hose mounting clips at this location, that is, cooperating pressure plate 64 received internally of the open upper end 38 of the overflow tube 40 and resiliently urged pressure finger 66 received externally thereof for the gripping action.

Thus, in the assembly with the water level control valve 10, the end of the flexible refill hose 36 is assembled telescoping the refill hose connecting end 50 of the refill hose mounting member 42 engaging over the circumferential flange 56 for firm retainment thereon. The gripping portion 62 of the retainer 44 is selectively engaged downwardly over the open upper end 38 of the overflow tube 40. As shown particularly in FIGS. 1, 2 and 3, the refill hose mounting member 52, partially as a result of the slight angularity of the extension of the retainer 44, is positioned precisely directing the refill water from the refill hose 36 downwardly into the upper open end 38 of the overflow tube 40.

It will be noted that due to the extension and projection of the refill hose connecting portion 48 on the rigid refill hose mounting member 42, the end of the flexible refill hose 36 may be easily and securely telescoped thereover for attachment thereto, and that it is not necessary to attempt to interfit with the end of the flexible refill hose any small metal clips as was true with the prior constructions. Furthermore, again due to the extension of the refill hose mounting member 42, the precise positioning thereof by the retainer 34 for exactly directing the refill water downwardly into the open upper end 38 of the overflow tube 40 is easily and securely accomplished. Although the gripping portion 62 of the retainer 44 is similar to the prior clips, this gripping portion can firmly position and retain the refill hose mounting member 42 and it is unnecessary for the retainer 44 to interengage with and attempt to position merely the end of a flexible refill hose as was true of the prior clip constructions.

As thus far described, therefore, the refill hose mounting member and retainer of the present invention illustrated in preferred embodiment form as the refill hose mounting member 42 and the retainer 44 constitutes a valuable addition to the assembly of the water level control valve 10 and is clearly advantageous over the prior simple metal clip constructions. In addition thereto, however, the refill hose mounting member 42 may be formed with a multiplicity, preferably four, of radially projecting and circumferentially aligned retainment tabs 68 longitudinally spaced inwardly from the circumferential flange 56 on the refill hose connecting portion 48 and a radially outwardly projecting circumferential flange 70 spaced inwardly of these retainment tabs also on the refill hose connecting portion 48. These retainment tabs 68 and flange 70 have no functional activity once the refill hose mounting member 42 and the retainer 44 are in final assembly with the water level control valve 10, but they are extremely valuable prior thereto during storage and shipment of the overall water level control valve assembly while it is in a disassembled state as will be described below.

Figure 4:
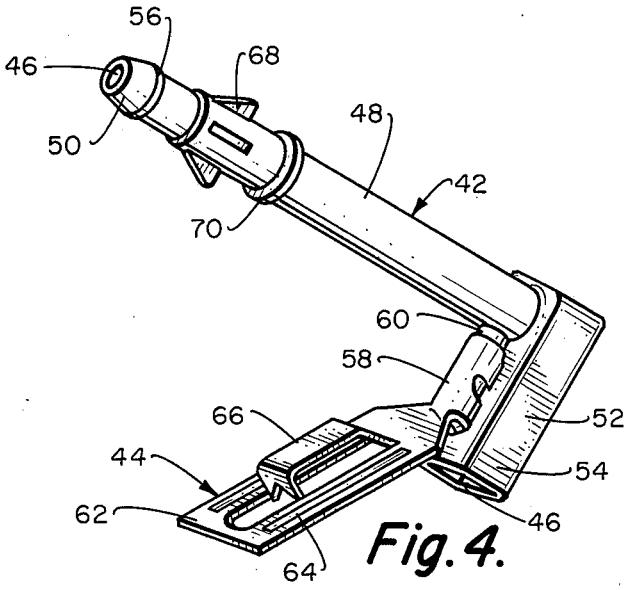
FIG. 4 is a perspective view of the preferred embodiment of the refill hose mounting member and retainer of the present invention removed from the water level control valve assembly of FIGS. 1 through 3.
Figure 5:
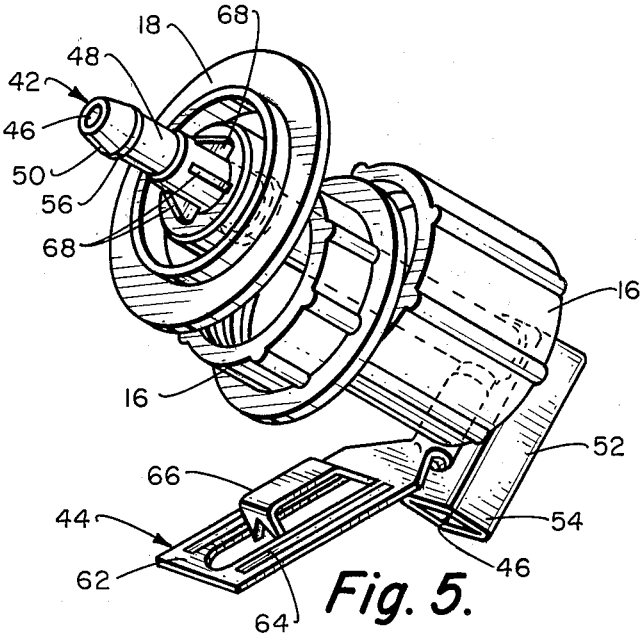
FIG. 5 is a view similar to FIG. 4, but with certain mounting parts of the water level control valve of FIG. 1 temporarily selectively removably retained thereon illustrating use of the refill hose mounting member and retainer during storage and shipment of the water level control valve with which it is ultimately assembled.

As shown in FIG. 4, prior to assembly with the water level control valve 10, the refill hose mounting member and retainer of the present invention has the retainment tabs 68 serving as a circumferential obstruction near the refill hose connecting end 50 of the refill hose connecting portion 48 and the overflow tube discharge portion 52 thereof with the assembled retainer 44 serving as a circumferential obstruction at the other end of the refill hose connecting portion. Thus, during storage and shipment, all of the later to be used mounting parts 16 for the final assembly of the water level control valve 10 in the flush tank may be telescoped over the refill hose connecting portion 48 longitudinally beyond the retainment tabs 68 with the last of these mounting parts placed in such telescoped positioning being the resilient washer 18 as clearly shown in FIG. 5. It will be noted that the internal diameter of the resilient washer 18 during storage and shipment is less than the radial projection of the retainment tabs 68 so it will be placed into the assembly of FIG. 5 by resiliently stretching the same over the retainment tabs 68 and positioning it between these retainment tabs and the flange 70, thereby retaining all of the remaining of the mounting parts 16 temporarily on the refill hose mounting member 42.

This thereby eliminates the necessity of otherwise retaining the mounting parts 16 for the water level control valve 10 during storage and shipment to the customer. All such parts are conveniently retained on this uniquely formed refill hose mounting member 42 with cooperation by the retainer 44 assembled therewith. Furthermore, when final assembly of the water level control valve 10 in the flush tank 12 is carried out, the mounting parts 16 are quickly and easily removed merely by first stretchably removing the resilient washer 18 and then the remaining mounting parts 16.

According to the present invention, therefore, a refill hose mounting member and retainer is provided which is of a completely new and unique construction clearly advantageous over any of the prior constructions. Furthermore, the refill hose mounting member and retainer may be formed to serve an additional function and that is to store the various mounting parts 16 required for the final assembly of the water level control valve 10 in the flush tank 12 during storage and shipment of the disassembled overall assembly. It is pointed out that all of the structure herein described including the preferred embodiment of the refill hose mounting member and retainer of the present invention may be formed of usual material and by usual manufacturing methods except as herein specifically pointed out and that the principles of the present invention are not limited to the specific embodiment of the refill hose mounting member and retainer shown, but are intended to be broadly construed and only limited by the specific limitations set forth in the appended claims including the patent equivalents thereof.

I claim:

1. A refill hose mounting member for positioning an end of a flexible refill hose directing water from a water level control valve in a toilet flush tank generally downwardly into an upper end of a generally vertical overflow tube; the refill hose mounting member including a rigid elbow having a fluid passage therethrough, said elbow comprising a relatively straight refill hose connecting portion starting at a connecting end connectable to the flexible refill hose end which may be telescopically expanded thereover in fluid communication therewith, said refill hose connecting portion terminating in an end of a relatively straight overflow tube discharge portion which in turn terminates in an open discharge end, longitudinal axis of said discharge portion being angularly displaced at substantially a right angle from longitudinal axis of said connecting portion, said discharge portion being of reduced longitudinal length compared to said connecting portion; the refill hose mounting member also including flexible clip means secured to said elbow discharge portion discharge end projecting generally longitudinally therefrom for mounting said discharge portion on the overflow tube upper end to positively direct fluid from said discharge portion open discharge end fully into the overflow tube.

2. A refill hose mounting member as defined in claim 1 in which said rigid elbow is formed of plastic and said flexible clip means is formed of metal.

3. A refill hose mounting member as defined in claim 1 in which a multiplicity of annular mounting parts of the water level control valve are temporarily stored thereon prior to use, said mounting parts being telescoped with said elbow connecting portion temporarily retained longitudinally between said elbow discharge portion and flexible clip means at one side and retainment means spaced longitudinally inwardly from said elbow connecting portion connecting end at an opposite side, said retainment means projecting transversely from said elbow connecting portion and forming a temporary longitudinal obstruction for a flexible one of said annular mounting parts temporarily retaining all of said mounting parts.

4. A refill hose mounting member as defined in claim 1 in which said retainment means comprises transversely spaced and aligned retainment tabs spaced longitudinally inwardly from said elbow connecting portion connecting end.

* * * * *

UNITED STATES PATENT AND TRADEMARK OFFICE

CERTIFICATE OF CORRECTION

PATENT NO. : 4,327,941

DATED : May 4, 1982

INVENTOR(S) : Adolf Schoepe

It is certified that error appears in the above-identified patent and that said Letters Patent is hereby corrected as shown below:

Column 8, Claim 4, lines 48 and 49, "claim 1" should be "claim 3."

Signed and Sealed this

*Seventeenth* Day of *August 1982*

[SEAL]

*Attest:*

GERALD J. MOSSINGHOFF

*Attesting Officer*

*Commissioner of Patents and Trademarks*